US006660444B2

(12) United States Patent
Mahabadi et al.

(10) Patent No.: US 6,660,444 B2
(45) **Date of Patent: *Dec. 9, 2003**

(54) CARRIER

(75) Inventors: Hadi K. Mahabadi, Etobicoke (CA); Enno E. Agur, Toronto (CA); Thomas E. Enright, Mississauga (CA); John A. Creatura, Ontario, NY (US); Mary L. Ott, Fairport, NY (US); K. Derek Henderson, Rochester, NY (US); Paul J. Gerroir, Oakville (CA)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/340,654

(22) Filed: Jan. 10, 2003

(65) Prior Publication Data

US 2003/0104303 A1 Jun. 5, 2003

Related U.S. Application Data

(62) Division of application No. 09/037,555, filed on Mar. 9, 1998, now Pat. No. 6,528,225.

(51) Int. Cl.[7] ..... G03G 9/10
(52) U.S. Cl. ..... 430/137.13
(58) Field of Search ..... 430/137.13, 111.35, 430/111.32, 111.1

(56) References Cited

U.S. PATENT DOCUMENTS

| | | | | |
|---|---|---|---|---|
| 3,533,835 A | | 10/1970 | Hagenbach et al. | 117/217 |
| 3,590,000 A | | 6/1971 | Palermiti et al. | 252/62.1 |
| 3,658,500 A | | 4/1972 | Hagenbach | 65/21 |
| 3,798,167 A | | 3/1974 | Kukla et al. | 252/62.1 |
| 3,918,968 A | | 11/1975 | Kukla et al. | 96/1.5 D |
| 3,922,382 A | | 11/1975 | Kukla et al. | 427/58 |
| 3,939,086 A | | 2/1976 | Hagenbach | 252/62.1 P |
| 4,233,387 A | | 11/1980 | Mammino et al. | 430/137 |
| 4,238,558 A | | 12/1980 | Ziolo | 430/108 |
| 4,264,697 A | | 4/1981 | Perez et al. | 430/107 |
| 4,310,611 A | | 1/1982 | Miskinis | 430/107 |
| 4,397,935 A | | 8/1983 | Ciccarelli et al. | 430/110 |
| 4,434,220 A | | 2/1984 | Abbott | 430/108 |
| 4,546,060 A | | 10/1985 | Miskinis et al. | 430/108 |
| 4,629,673 A | * | 12/1986 | Osawa et al. | 430/111.3 |
| 4,764,445 A | | 8/1988 | Miskinis et al. | 430/108 |
| 4,855,205 A | | 8/1989 | Saha et al. | 430/106.6 |
| 4,855,206 A | | 8/1989 | Saha et al. | 430/106.6 |
| 4,937,166 A | | 6/1990 | Creatura et al. | 430/108 |
| 5,002,846 A | | 3/1991 | Creatura et al. | 430/108 |
| 5,015,550 A | | 5/1991 | Creatura et al. | 430/108 |
| 5,204,204 A | * | 4/1993 | Shintani et al. | 430/108 |
| 5,236,629 A | | 8/1993 | Mahabadi et al. | 252/511 |
| 5,670,287 A | * | 9/1997 | Kawata et al. | 430/137 |
| 5,849,448 A | * | 12/1998 | Yoshino et al. | 430/108 |
| 5,998,076 A | * | 12/1999 | Mahabadi et al. | 430/111.32 |

FOREIGN PATENT DOCUMENTS

| | | | | |
|---|---|---|---|---|
| JP | 58-216260 | * | 12/1983 | 430/108 |

OTHER PUBLICATIONS

Webster's II New Riverside Dictionary. Riverside Publishing Company. p. 916 1984.*

* cited by examiner

*Primary Examiner*—Christopher Rodee
(74) *Attorney, Agent, or Firm*—E. D. Palazzo

(57) ABSTRACT

Carrier comprised of a core, a number of the pores thereof containing a polymer, and thereover a coating.

17 Claims, No Drawings

CARRIER

CROSS-REFERENCE TO RELATED APPLICATIONS

This is a divisional of application Ser. No. 09/037,555 filed Mar. 9, 1998, now U.S. Pat. No. 6,528,225.

RELATED PATENT

Illustrated U.S. Pat. No. 5,998,076, the disclosure of which is totally incorporated herein by reference, is a carrier comprised of a hard magnetic core, a number of, or all of the pores thereof being filled with polymer and thereover a coating and a carrier comprised of a porous hard magnetic core and wherein the pores thereof are filled with a polymer and which carrier contains a coating thereover of a polymer, or a polymer mixture.

BACKGROUND OF THE INVENTION

This invention is generally directed to developer compositions, and more specifically, the present invention relates to developer compositions with certain carriers. In embodiments of the present invention the carrier particles can be prepared by insitu processes and which carriers are comprised of a metallic core, or a metal oxide core, and preferably a porous metallic core or porous metal oxide core with a polymer contained in a number of the pores, that is for example from about 70 to about 90 percent of the pores, or all the pores that is about 100 percent of the pores, and wherein each of the pores is filled with polymer, for example from about 50 to about 100 percent, and preferably from about 90 to about 100 percent, and processes thereof. The carriers of the present invention may be mixed with a toner of resin, colorant, and optional toner additives to provide developers that can be selected for the development of images in electrostatographic, especially xerographic imaging systems, and digital systems.

Insitu refers for example, to polymerization of monomer being accomplished simultaneously inside the carrier pores and at the surfaces of the carrier core particles, and porous refers for example, to a foam-like structure, or a core that contains a plurality of pores.

PRIOR ART

The electrostatographic process, and particularly the xerographic process, is well known. This process involves the formation of an electrostatic latent image on a photoreceptor, followed by development and subsequent transfer of the image to a suitable substrate. Numerous different types of xerographic imaging processes are known wherein, for example, insulative developer particles or conductive toner compositions are selected depending on the development systems used. Of importance with respect to the aforementioned developer compositions is the appropriate triboelectric charging values associated therewith, as it is these values that enable for example, continued constant developed images of high quality and excellent resolution.

Carrier particles for use in the development of electrostatic latent images are described in many patents including, for example U.S. Pat. No. 3,590,000. These carrier particles may contain various cores, including steel, with a coating thereover of fluoropolymers, or terpolymers of styrene, methacrylate, and silane compounds. Recent efforts have focused on the attainment of coatings for carrier particles, for the purpose of improving development quality; and also to permit particles that can be recycled, and that do not adversely effect the imaging member in any substantial manner. Some of the present commercial coatings can deteriorate, especially when selected for a continuous xerographic process where the entire coating may separate from the carrier core in the form of chips or flakes, and fail upon impact, or abrasive contact with machine parts and other carrier particles. These flakes or chips, which are not generally reclaimed from the developer mixture, have an adverse effect on the triboelectric charging characteristics of the carrier particles thereby providing images with lower resolution in comparison to those compositions wherein entire carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is illustrated in U.S. Pat. No. 4,233,387, the disclosure of which is totally incorporated herein by reference, coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which has been totally incorporated herein by reference, are suitable for their intended purposes, the conductivity values of the resulting particles are not believed to be constant in all instances, for example, when a change in carrier coating weight is accomplished to achieve a modification of the triboelectric charging characteristics; and further with regard to the '387 patent, in many situations carrier and developer mixtures with only specific triboelectric charging values can be generated when certain conductivity values or characteristics are contemplated. With the invention of the present application, the conductivity of the resulting carrier particles are in embodiments substantially constant, and moreover the triboelectric values can be selected to vary significantly, for example, from less than about 80 microcoulombs per gram to greater than about −80 microcoulombs per gram, depending on the polymer mixture selected for affecting the coating processes. Also, with the present invention monomer is initially selected and polymerized insitu and not polymer as is the situation with the above prior art, thus for example with the present invention the carrier pores can be completely filled with monomer and after polymerization with polymer. Penetration of the carrier pores of the present invention are enabled, for example, by the substantially lower viscosity and higher diffusivity of the monomer as compared to the corresponding polymer melt.

With further reference to the prior art, carriers obtained by applying insulating resinous coatings to porous metallic carrier cores using solution coating techniques are undesirable from many viewpoints. For example, insufficient coating material may be present; and therefore is not as readily available for triboelectric charging when the coated carrier particles are mixed with finely divided toner particles. Attempts to resolve this problem by increasing the carrier coating weights, for example, to 3 percent or greater to provide a more effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses. Powder coating processes have been utilized to overcome these disadvantages, and further to enable developer mixtures that are capable of generating high and useful triboelectric charging values with finely divided toner particles; and also wherein the carrier particles are of substantially constant conductivity. Further, when resin coated carrier particles are prepared by the powder coating process, the majority of the coating materials are fused to the carrier surface thereby reducing the number of toner impaction sites on the carrier material.

Powder coating processes typically require polymers in the form of fine powders which can be mixed and properly coat the carrier core. The triboelectric charging value of the aforementioned carriers can be controlled by the polymer or mixture of polymers selected for the coating. The disadvantage of this approach is that only a limited number of polymers are available in the form of fine powders, especially for the preparation of conductive carriers. Two approaches are known in the prior art for fabricating conductive carriers. First, conductive polymers which are in the form of fine powder can be utilized, for example, a conductive carbon black loaded polymer, reference U.S. Pat. No. 5,236,629, the disclosure of which is totally incorporated herein by reference. A second approach is to partially coat the carrier core with polymer. However, coatings prepared by this method have the tendency to chip or flake off, and fail upon impact, or abrasive contact with machine parts and other carrier particles. These flakes or chips, which cannot readily be reclaimed from the developer mixture, have an adverse effect on the triboelectric charging characteristics of the carrier particles, thereby providing images with lower resolution in comparison to those compositions wherein the carrier coatings are retained on the surface of the core substrate. Furthermore, partially coated carriers have a short life, for example from about 1 to about 30 days and poor stability. The powder coating process has the disadvantage of not being able to, it is believed, consistently coat small size core particles such as for example less about 50 microns primarily because of the polymer and the core forming aggregated particles, which are generated during the coating process. The aforementioned aggregation can partially be alleviated by applying partial coatings in a multi-pass process, for example a high polymer coating weight per pass is applied in about two to three passes. However, this can result in a higher amount of agglomeration and a lower yield. A lower coating weight per pass can also be applied with for example a number of passes, such as 10, which will result in increasing the cost of the carrier generated.

Other patents of interest include U.S. Pat. No. 3,939,086, which illustrates steel carrier beads with polyethylene coatings, see column 6; U.S. Pat. No. 4,264,697, which discloses dry coating and fusing processes; U.S. Pat. Nos. 3,533,835; 3,658,500; 3,798,167; 3,918,968; 3,922,382; 4,238,558; 4,310,611; 4,397,935; 5,015,550, 5,002,846, 4,937,166, and 4,434,220.

Certain ferrite carriers are illustrated in U.S. Pat. Nos. 4,546,060, 4,764,445, 4,855,205, and 4,855,206. In the U.S. Pat. No. 4,855,205 there is disclosed a two phase ferrite composite, with a spinel or S phase of the formula $MFe_2O_4$ and a magnetoplumbite or M phase and which composite and magnetized. It is indicated in column 3 of this patent that the composites can be prepared by conventional procedures and that the composite can be coated with a polymer well known in the art. Examples of polymers include those as illustrated in U.S. Pat. No. 4,546,060, such as fluorocarbon polymers, like polytetrafluoroethylene, polyvinylidenefluoride, arid the like, see column 8.

The disclosures of each of the above patents are totally incorporated herein by reference. The appropriate carrier cores and polymer coatings of these patents may be selected for the present invention in embodiments thereof.

SUMMARY OF THE INVENTION

It is an feature of the present invention to provide toner and developer compositions with many of the advantages illustrated herein, and which carriers may contain a polymer, or polymer mixture coating and for example, and polymerization processes for generating carrier particles of substantially constant conductivity parameters, and wherein crosslinking of the polymer in the carrier pores and on the surface improves the mechanical properties of the carrier; the carrier resulting is lighter such as for example from about 50 to about 500 percent lighter than a solid core coated with polymer resulting in less impaction; a wide range of monomers or comonomers can be used for the control of triboelectric charging; and the need for small size polymeric materials for powder coating processes is eliminated, or minimized.

In yet another feature of the present invention there are provided insitu polymerization processes for generating carrier particles of and synthetic carriers, substantially constant conductivity parameters, and a wide range of preselected triboelectric charging values.

In yet a further feature of the present invention there are provided carrier particles comprised of a coating generated from a mixture of monomers that are not in close proximity in the triboelectric series, that is for example, a mixture of monomers from different positions in the triboelectric series.

In still a further feature of the present invention there are provided carrier particles with insulating characteristics comprised of a metallic or metal oxide core, and wherein the carrier is porous and has added to substantially all of its pores thereof a monomer, subsequently polymerized to polymer, inclusive of a crosslinked polymer, and which carrier may contain a continuous coating thereover generated from a mixture of polymers, and which coating forms a complete full layer on the carrier core.

In another feature of the present invention there are provided carrier particles of conducting characteristics comprised of a metallic or metal oxide core, and wherein the carrier is porous, for example about 50 percent porous and has added to substantially all the pores thereof a monomer subsequently polymerized to polymer, inclusive of a crosslinked polymer, and which carrier may contain a partial coating thereover generated from a mixture of polymers.

In yet another feature of the present invention there are provided carrier particles of conducting characteristics comprised of a metallic or metal oxide core, and wherein the carrier is porous and has added to substantially all the pores thereof a monomer subsequently polymerized to polymer, inclusive of a crosslinked polymer, and which carrier may contain a complete coating thereover generated from a mixture of conductive polymers.

Further, in an additional feature of the present invention there are provided carrier particles comprised of a porous core, wherein the pores are filled with a monomer subsequently polymerized to polymer, inclusive of a crosslinked polymer, and with a coating thereover generated from a mixture of polymers and wherein the carrier triboelectric charging values are from about −80 to about 80 microcoulombs per gram at the same coating weight as determined by the known Faraday cage technique.

Also, in another feature of the present invention there are provided positively charged toner compositions, or negatively charged toner compositions having incorporated therein metal or metal oxide filled carrier particles with a coating thereover of a polymer, a mixture of polymer coatings thereover, and preferably a mixture of two polymers.

The present invention relates to carriers and processes thereof and wherein the process of preparation comprises for example subjecting carrier particles to a polymerization process wherein a monomer, or a mixture of monomers is simultaneously polymerized in the pores and on the surface of the carrier enabling carrier particles with relatively constant conductivity parameters; and also wherein the triboelectric charge on the carrier can vary significantly depending on the monomers selected, reference for example U.S. Pat. Nos. 4,937,166 and 4,935,326, the disclosures of which are totally incorporated herein by reference; subjecting carrier particles to a polymerization process wherein a monomer or a mixture of monomers is simultaneously polymerized in the pores or on the surface of the carrier enabling, for example insulative carrier particles with relatively constant conductivity parameters, and also wherein the triboelectric charge on the carrier can vary significantly depending for example, on the monomers selected; subjecting carrier particles to a polymerization process wherein a mixture of monomers is simultaneously polymerized in the pores and on the surface of the carrier enabling, for example conductive carrier particles with relatively constant conductivity parameters.

Aspects of the present invention relate to carrier comprised of a core, a number of the pores thereof containing a polymer, and thereover a coating; carrier comprised of a porous core and wherein a number of the pores thereof contain a (1) polymer, or a mixture of polymers and which carrier contains a (2) coating thereover of a polymer, or optionally a mixture of polymers; carrier wherein substantially all of said carrier pores contain said polymer (1) and said polymer (1) and/or (2) each further contains conductive components; carrier wherein said core diameter is about 30 to about 100 microns; Carrier wherein said polymer (1) is a crosslinked polymer and said polymer (2) is a crosslinked polymer; carrier wherein porous is represented by a BET area of about 500 to about 5,000 $cm^2$/gram; carrier wherein porous is represented by a BET area of about 1,000 to about 3,000 $cm^2$/gram; carrier wherein said core is iron, steel or a ferrite; carrier wherein said polymer (1), and said polymer (2) is a vinyl polymer or a condensation polymer; carrier wherein polymer (1) is polyvinylidenefluoride, polyethylene, polymethylmethacrylate, polytrifluoroethylmethacrylate, copolyethylenevinylacetate, copolyvinylidenefluoride, tetrafluoroethylene, polystyrene, tetrafluoroethylene, polyvinyl chloride, polyvinyl acetate, polyvinyl acetate, or mixtures thereof, and wherein said polymer (2) is polyvinylidenefluoride, polyethylene, polymethylmethacrylate, polytrifluoroethylmethacrylate, copolyethylenevinylacetate, copolyvinylidenefluoride, tetrafluoroethylene, polystyrene, tetrafluoroethylene, polyvinyl chloride, polyvinyl acetate, polyvinyl acetate, or mixtures thereof; carrier wherein said polymer (1) is polymethylmethacrylate, polystyrene, polytrifluoroethylmethacrylate, or mixtures thereof, and said polymer (2) is polymethylmethacrylate, polystyrene, polytrifluoroethylmethacrylate, or mixtures thereof; carrier wherein said polymer (1) and said polymer (2) is comprised of a mixture of polymethylmethacrylate, and polytrifluoroethylmethacrylate; carrier wherein said conductive component is an additive of a conductive carbon black, metal oxide, metal, or mixtures thereof; carrier wherein said conductive component is carbon black; carrier wherein said polymer (1) and said polymer (2) is present in a total amount of from about 0.5 to about 10 percent by weight of said carrier; carrier wherein said polymer (1) and said polymer (2) is present in a total amount of from about 1 to about 5 percent by weight of said carrier; carrier wherein said conductive component is present in an amount of from about 10 to about 70 percent by weight of said polymer (1), or said polymer (2); carrier wherein said conductive component is present in an amount of from about 20 to about 50 percent by weight of said polymer (1), or said polymer (2); carrier with a triboelectric charge value of from about −80 to about 80 microcoulombs/gram; carrier with a conductivity of from about $10^{-17}$ to about $10^{-4}$ mho/cm; carrier with a triboelectric charge value of from about 60 to about 60 microcoulombs/gram and a conductivity of from about $10^{-15}$ to about $10^{-6}$ mho/cm; a process for the preparation of carrier comprised of mixing carrier core with a mixture of monomer and initiator, optional chain transfer agent, and optional crosslinking agent; polymerizing the monomer by heating thereby resulting in a polymer contained in a number of the carrier pores and on the carrier surface; and optionally drying; an insitu process for the preparation of carrier comprising mixing carrier core with a mixture of monomer and initiator, optional chain transfer agent, and optional crosslinking agent; polymerizing the monomer by heating thereby resulting in a polymer, or crosslinked polymer in the carrier pores and on the carrier surface; mixing the carrier core containing polymer and monomer mixture inside the pores and on the carrier surface with water; completing the polymerization and optionally crosslinking by heating thereby resulting in a polymer, or crosslinked polymer in the carrier pores and on the carrier surface; removing the water from the mixture; and optionally drying; a process wherein the monomer mixture further contains a conductive additive; a process wherein excess monomer is removed by filtration; the water is removed from the mixture by filtration; and drying in an oven; a process wherein the mixture is heated at a temperature from about 50° C. to about 95° C., or from about 60° C. to about 85° C.; a process wherein the mixture is heated for a period of from about 30 minutes to about 5 hours, or from about 30 minutes to about 3 hours; a process wherein the monomer is selected from the group consisting of styrene, α-methyl styrene, p-chlorostyrene, monocarboxylic acids and the derivatives thereof; dicarboxylic acids with a double bond and their derivatives; vinyl ketones; vinyl naphthalene; unsaturated mono-olefins; vinylidene halides, N-vinyl compounds; fluorinated vinyl compounds; and mixtures thereof; and wherein said monomer is optionally present in an amount of from about 0.5 to about 10 percent by weight, or from about 1 to about 5 percent by weight of said carrier core; a process wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; and wherein said monomer is present in an amount of from 0.5 to about 10 percent by weight, or from about 1 to about 5 percent by weight of said carrier core; a process wherein the monomer is methyl methacrylate, styrene, trifluoroethyl methacrylate, or mixtures thereof, and wherein said monomer is present in an amount of from 0.5 to about 10 percent by weight, or from about 1 to about 5 percent by weight of said carrier core; a process wherein the conductive additive is selected from the group consisting of conductive carbon blacks, metal oxides, metals, and mixtures thereof, and where the amount of said conductive additive present is from about 10 to about 70 percent by weight, or from about 20 to about 50 percent by weight of said monomer mixture; a process wherein the conductive additive is conductive carbon black; a process wherein the initiator is selected from the group consisting of azo compounds, peroxides, and mixtures thereof, and where the amount of said initiator is from about 0.1 to about 20 percent by weight, or from about 0.5 to about 10 percent by weight of said monomer mixture; a process wherein the initiator is selected from the group consisting of 2,2'azodimethylvaleronitrile, 2,2'azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4, 4-di-(t-butylperoxy)valerate, dicumyl peroxide, and mixtures thereof; a process wherein the crosslinking agent is selected from the group consisting of compounds having two or more polymerizable double bonds, and where the amount of said crosslinking agent is from about 0.1 to about 5 percent by weight, or from about 0.5 to about 3 percent by weight of said monomer mixture; a process wherein the crosslinking agent is selected from the group consisting of divinylbenzene, divinylnaphthalene, ethylene glycol diacrylate, ethylene glycol dimethylacrylate, divinyl ether, divinyl sulfite, divinyl sulfone, and mixtures thereof; a process wherein the chain transfer agent is selected from the group consisting of mercaptans and halogenated hydrocarbons, and where chain transfer agent is selected in an amount of from about 0.01 to about 1 percent by weight, or from about 0.05 to about 0.5 percent by weight of said monomer mixture; a process wherein the chain transfer agent is selected from the group consisting of laurylmercaptan, butylmercaptan carbon tetrachloride, carbon tetrabromide and mixtures thereof; a developer comprised of the carrier and toner; carrier wherein all of said carrier pores are filled with polymer (1); carrier wherein substantially all of said pores contain polymer (1); carrier wherein all of said core pores contain polymer (1); a developer comprised of the carrier and toner; carrier wherein said number of pores containing polymer (1) is from about 70 to about 100 percent; carrier wherein each of the carrier pores contains from about 50 to about 100 percent of polymer; carrier wherein said polymer (1) and/or said polymer (2) further contains conductive components; carrier wherein said number is substantially all of said pores; carrier wherein said polymer (2) is an organosiloxane, or an organosilane.

With the carriers of the present invention a number of the pores thereof can contain polymer, for example from about 70 to about 100 percent of the pores, and preferably from about 80 to about 100 percent of the pores. Each of the carrier pores can contain up to 100 percent of the polymer selected, that is each of the pores is completely filled at 100 percent, or each of the pores can be partially filled, for example from about 50 to about 99 percent, and preferably from about 75 to about 95 percent of polymer selected.

The carriers of the present invention in aspects thereof are comprised of a suitable known core, a polymer contained in the pores of the core and on the surface thereof, wherein each polymer is preferably similar, and wherein the pore polymer (1) and the coating polymer (2) are present in a total amount of from about 0.5 to about 10 percent by weight of the carrier, and preferably from about 1 to about 5 percent by weight of the carrier, and more specifically wherein the amount of the pore polymer (1) is from about 40 to about 95 percent by weight of total polymer, and preferably from about 60 to about 90 percent by weight of total polymer; and the amount of polymer (2) ranges from about 5 to about 60 percent by weight of total polymer, and preferably from about 10 to about 40 percent by weight of total polymer.

Insulative carrier particles can be obtained with the processes of the present invention and can be prepared by a heterogeneous polymerization and wherein there is mixed suitable core such as a metallic core or metal oxide core with a high porosity as exemplified by BET area of for example, from about 500 to about 5,000 $cm^2/g$, and preferably from about 1,000 to about 3,000 $cm^2/g$ as determined by BET single point method using krypton gas, and which cores are of a volume average diameter of for example, from about 30 to about 100 microns, and preferably from about 30 to about 50 microns as measured by a Malvern laser diffractometer, with a monomer containing initiator, optionally chain transfer agent, optionally crosslinking agent, and other-optional additives such as charge enhancing additives, and wherein the core pores are filled and the core surfaces are substantially fully covered with these components; polymerizing the monomer by for example heating thereby resulting in a polymer, or crosslinked polymer in the carrier pores and on the carrier surface; and drying.

Also, the present invention relates to conductive carrier particles prepared by a heterogeneous polymerization and wherein there is mixed a suitable core, such as a porous metallic core or metal oxide core, and which cores are of a volume average diameter of from about 30 to about 100 microns, and preferably from about 30 to about 50 microns as measured by a Malvern laser diffractometer, with a monomer containing initiator, optionally chain transfer agent, optionally crosslinking agent, and other optional additives such as charge enhancing additives, and wherein the core pores are filled and the core surface is partially covered with these components, for example from about 30 to about 90 percent of the total surface area; followed by polymerizing the monomer by for example heating thereby resulting in a polymer, or crosslinked polymer in the carrier pores and on the carrier surface; and drying; conductive carrier particles prepared by a heterogeneous polymerization and wherein there is mixed a porous metallic core or metal oxide core, and which cores are of a volume average diameter of from about 30 to about 100 microns, and preferably from about 30 to about 50 microns as measured by a Malvern laser diffractometer, with a monomer containing initiator and conductive additive such as for example conductive carbon black, optionally chain transfer agent, optionally crosslinking agent, and other optional additives such as known charge enhancing additives, and wherein the core pores are filled and the core surface substantially fully covered with these components; polymerizing the monomer by for example heating thereby resulting in a polymer, or crosslinked polymer in the carrier pores and on the carrier surface; and drying; and carrier particles comprised of filled metallic or metal oxide core with a coating thereover comprised of a polymer mixture obtained for example by polymerization of a first monomer component and a second monomer component, which are not in close proximity in the triboelectric series. Subsequently, developer compositions can be generated by admixing the aforementioned carrier particles with a toner composition comprised of resin particles and pigment particles.

With further reference to the monomer mixture utilized to achieve the polymer or copolymer coating, close proximity refers to the choice of the polymers selected as dictated by their position in the triboelectric series, therefore for example, one may select a first polymer with a significantly lower triboelectric charging value than the second polymer. For example, the triboelectric charge of a steel carrier core with a polyvinylidenefluoride coating is about −75 microcoulombs per gram. However, the same carrier, to with the exception that there is selected a coating of polymethylmethacrylate, has a triboelectric charging value of about 40 microcoulombs per gram. More specifically, not in close proximity refers to first and second polymers that are at different electronic work function values, that is the polymers are not at the same electronic work function value; and further, the first and second polymers are comprised of different components. Additionally, the difference in electronic work functions in embodiment is between the first and second polymer is for example at least 0.2 electron volt, and preferably is about 2 electron volts; and moreover, it is known that the triboelectric series corresponds to the known electronic work function series for polymers, reference "Electrical Properties of Polymers", Seanor, D. A., Chapter 17, Polymer Science, A. D. Jenkins, Editor, North Holland Publishing (1972), the disclosure of which is totally incorporated herein by reference.

The percentage of each polymer present in the carrier coating mixture can vary depending on the specific components selected, the coating weight and the properties desired. Generally, the coated polymer mixtures contains from about 10 to about 90 percent of a first polymer, and from about 90 to about 10 percent by weight of a second polymer. Preferably, there are selected mixtures of polymers with from about 40 to 60 percent by weight of a first polymer, and from about 60 to 40 percent by weight of a second polymer. In one embodiment of the present invention, when a high triboelectric charging value is desired, that is, exceeding −50 microcoulombs per gram, there is selected and the carrier coating from about 90 percent by weight of the first polymer such as vinylidenefluoride; and 10 percent by weight of the second polymer such as methyl methacrylate. In contrast, when a lower triboelectric charging value is required, less than about −20 microcoulombs per gram, there is selected from about 10 percent by weight of the first polymer; and 90 percent by weight of the second polymer.

Also, there results, in accordance with aspects of the present invention, carrier particles of relatively constant conductivities from about $10^{-17}$ mho/cm to about $10^{-4}$ mho/cm, and preferably from about $10^{-15}$ mho/cm to about $10^{-6}$ mho/cm at, for example, a 10 volt impact across a 0.1 inch gap containing carrier beads held in place by a magnet; and wherein the carrier particles are of a triboelectric charging value of from about −80 to about 80 microcoulombs per gram, and preferably from about −60 to about 60 microcoulombs per gram as determined by a Faraday Cage, these parameters being dependent on the coatings selected, and the percentage of each of the polymers used as indicated hereinbefore.

Various suitable porous solid core carrier materials can be selected, inclusive of known porous cores. Characteristic core properties of importance include those that are porous that will enable the toner particles to acquire a positive or a negative charge, and carrier cores that will permit desirable flow properties in the developer reservoir present in the xerographic imaging apparatus. Also of value with regard to the carrier core properties are, for example, suitable soft magnetic characteristics that permit magnetic brush formation in magnetic brush development processes, and wherein the carrier cores possess desirable aging characteristics. By soft magnetic it is meant a developer that develops an induced magnetic field only when exposed to an external magnetic field, and which field is immediately diminished when the external field is removed. Examples of porous carrier cores that can be selected include iron, iron alloys, steel, ferrites, magnetites, nickel, and mixtures thereof. Alloys of iron include ironsilicon, iron-aluminum-silicon, iron-nickel, iron-cobalt, and mixtures thereof. Ferrites include a class of magnetic oxides that contain iron as the major metallic component and optionally a second metallic component including magnesium, manganese, cobalt, nickel, zinc, copper, and mixtures thereof. Preferred porous carrier cores include ferrites containing iron, nickel, zinc, copper, manganese, and mixtures thereof and sponge iron, with a volume average diameter from about 30 to about 100 microns, and preferably from about 30 to about 50 microns as measured by a Malvern laser diffractometer, and having a porosity as exemplified by BET area of for example from about 500 to about 5,000 $cm^2/g$, and preferably from about 1,000 to about 3,000 $cm^2/g$ as determined by BET single point method using krypton gas.

Examples of monomers or comonomers which can be polymerized in the carrier pores and on the surface in an amount of, for example, from about 0.5 to about 10 percent, and preferably from about 1 to about 5 percent by weight of carrier core include vinyl monomers such as styrene, p-chlorostyrene, vinyl naphthalene and the like; monocarboxylic acids and their derivatives such as acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloracrylate, methacrylic acids, methyl methacrylate, ethyl methacrylate, butyl methacrylate, octyl methacrylate, acylonitrile, methacrylonitrile, acrylamide and trifluoroethyl methacrylate, dicarboxylic acids having a double bond and their derivatives such as maleic acid, monobutyl maleate, dibutyl maleate, unsaturated monoolefins such as ethylene, propylene, butylene and isobutylene; vinyl halides such as vinyl chloride, vinyl bromide, vinyl fluoride; vinyl esters such as vinyl acetate, vinyl propionate, vinyl benzoate and vinyl butyrate; vinyl ethers, inclusive of vinyl methyl ether, vinyl isobutyl ether and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl compounds such as N-vinyl indole and N-vinyl pyrrolidene; fluorinated monomers such as pentafluoro styrene, allyl pentafluorobenzene and the like, other suitable known monomers, and mixtures thereof.

Crosslinked polymers with degree of crosslinking in the range from about 50 to about 100 percent, and preferably from about 75 to about 80 percent resulting after polymerization include polyamides, epoxies, silicone polymers, polyurethanes, diolefins, vinyl resins, styrene acrylates, styrene methacrylates, styrene butadienes, polyesters, copolymers and mixtures thereof. Specific examples of polymer or copolymer mixtures are polyvinylidenefluoride and polyethylene; polymethylmethacrylate and copolyethylenevinylacetate; copolyvinylidenefluoride tetrafluoroethylene and polyethylene; polymethylmethacrylate and copolyethylene vinylacetate; and polymethylmethacrylate and polyvinylidenefluoride. Other suitable polymer and polymer mixtures may be selected, such as for example polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate.

Polymers thereof are formed in the carrier pores and on the carrier surface, such as polystyrene, polytrifluoroethylmethacrylate, polymethylmethacrylate, and the like inclusive of the polymers formed from the monomers illustrated herein. Preferred in embodiments are crosslinked polymers for the carrier pores and the carrier surface.

Illustrative examples of polymerization initiators selected in an amount of, for example, from about 0.1 to about 20 percent, and preferably from about 0.5 to about 10 percent by weight of monomer include known initiators such as azo compounds such as 2,2'azodimethylvaleronitrile, 2,2'azoisobutyronitrile, azobiscyclohexanenitrile, 2-methylbutyronitrile and the like, and organic peroxides such as benzoyl peroxides, lauryl peroxide, 1-1-(t-butylperoxy)-3,3,5-trimethylcyclohexane, n-butyl-4,4-di-(t-butylperoxy)valerate, dicumyl peroxide and the like, and mixtures thereof.

Crosslinking agents selected for the process of the present invention are known and can be comprised of compounds having two or more polymerizable double bonds. Examples of such compounds include aromatic divinyl compounds such as divinylbenzene and divinylnaphthalene; carboxylic acid esters having two double bounds such as ethylene glycol diacrylate, ethylene, glycol dimethylacrylate and the like; divinyl compounds such as divinyl ether, divinyl sulfite, divinyl sulfone and the like, with divinylbenzene being preferred. The crosslinking component is preferably selected in the amount of from about 0.1 to about 5 percent, and preferably from about 0.5 to about 3 percent by weight of monomer or comonomer mixture.

Examples of conductive additives, or components present in the polymer carrier coating in amounts for example, of from about 10 to about 70 percent, and preferably from about 20 to about 50 percent by weight of monomer or comonomer mixture, include for example, conductive carbon blacks such as acetylene black, available from Chevron Chemical, VULCAN BLACK™, BLACK PEARL L®, KEYTJEN BLACK EC600JD®, available from AK20, CONDUCTEX SC ULTRA™, available from Columbian Chemicals, metal oxides such as iron oxides, TiO, $SnO_2$ and metal powders such as iron powder. These additives are preferably incorporated into the polymer coating during the polymerization process. The primary purpose of the conductive additive, or component is to increase the conductivity of the carrier.

Chain transfer agents selected, and which primarily function to control the polymer molecular weight by inhibiting chain growth include known agents, such as mercaptans such as laurylmercaptan, butylmercaptan and the like, or halogenated carbons such as carbon tetrachloride or carbon tetrabromide, and the like. The chain transfer agent is preferably selected in the amount of from about 0.01 to about 1 percent, and more preferably from about 0.05 to about 0.5 percent by weight of monomer or comonomer mixture.

The number-average molecular weight ($M_n$) of the linear portion of the polymer formed in the pores and on the surface is for example, in the range of from about $10^3$ to about $10^6$ as measured by gel permeation chromatography (GPC), with a weight-average molecular weight ($M_w$) of the linear portion of the polymer being in the range from about $5\times10^4$ to about $3\times10^6$.

The process for generating insulative carrier particles comprises for example, mixing the porous core with a monomer or mixture of monomers, preferably from one to about five monomers, in the range amount of from about 0.5 to about 10 percent by weight, and preferably from about 1 to about 5 percent by weight of carrier core, initiator in the range amount of from about 0.1 to about 20 percent by weight, and preferably from about 0.5 to about 10 percent by weight of monomer mixture, optional chain transfer agent in the range amount of from about 0.01 to about 1 percent by weight, and preferably from about 0.05 to about 0.5 percent by weight of monomer mixture, and optional crosslinking agent in the range amount of from: about 0.1 to about 5 percent by weight, and preferably from about 0.5 to about 3 percent by weight of monomer mixture in a stirred reactor vessel for a period of time of for example, from about 5 minutes to about 1 hour to allow the mixture to diffuse into the carrier pores; polymerizing to a conversion of from about 5 to about 40 percent by heating to a temperature of for example, from about 50° C. to about 95° C., and preferably from about 60° C. to about 85° C. for a period of time in the range of for example, from about 30 minutes to about 5 hours and wherein the polymer resulting fills substantially all or a number of the carrier pores, or a number of the carrier pores and covers substantially all the carrier surface and wherein the carrier particles do not substantially adhere to each other; removing excess monomer from the carrier surface by for example filtration; mixing the carrier core containing polymer and monomer mixture inside the pores and on the carrier surface in water; completing the polymerization and preferably crosslinking by a second heating to a temperature in the range of for example, from about 50° C. to about 95° C., and preferably from about 60° C. to about 85° C. and mixing the mixture for a period of time in the range of for example, from about 1 hour to about 5 hours and wherein the rate of stirring is substantially the same as in the mixing step; removing the water from the mixture by for example decantation; and drying resulting in for example, insulative carriers with crosslinked polymer in the pores, and on the surface.

The process for generating conductive carrier particles comprises for example, mixing the core, preferably conductive porous core with a monomer, or mixture of monomers in the range amount of from about 0.5 to about 10 percent by weight, and preferably from about 1 to about 5 percent by weight of carrier core and wherein amount of the monomer mixture ranges from about 30 to about 95 percent of the amount needed to obtain a substantially full surface coating, initiator in the range amount of from about 0.1 to about 20 percent by weight, and preferably from about 0.5 to about 10 percent by weight of monomer mixture, optional chain transfer agent in the range amount of from about 0.01 to about 1 percent by weight, and preferably from about 0.05 to about 0.5 percent by weight of monomer mixture, and optional crosslinking agent in the range amount of from about 0.1 to about 5 percent by weight, and preferably from about 0.5 to about 3 percent by weight of monomer mixture in a stirred reactor vessel for a period of time of for example, from about 5 minutes to about 1 hour in order to allow the aforementioned mixture to diffuse into the carrier pores;

polymerizing to a conversion of from about 5 to about 20 percent by heating to a temperature of for example, from about 50° C. to about 95° C., and preferably from about 60° C. to about 85° C. for a period of time in the range of for example, from about 30 minutes to about 5 hours and wherein the polymer resulting substantially fills all or a number of the carrier pores and partially covers the carrier surface and wherein the carrier particles do not adhere to each other; removing excess monomer from carrier surface by for example filtration; mixing the carrier core containing polymer and monomer mixture inside the pores and on the carrier surface into water; completing the polymerization and preferably crosslinking by heating to a temperature in the range of for example, from about 50° C. to about 95° C., and preferably from about 60° C. to about 85° C. and mixing the mixture for a period of time in the range of for example, from about 1 hour to about 5 hours and wherein the rate of stirring is substantially the same as in the mixing step; removing the water from the mixture by for example decantation; and drying resulting in conductive carrier with crosslinked polymer in the pores, and on the surface.

The process for generating conductive carrier particles can also comprise mixing the core with monomers, or a mixture of monomers in the range amount of from about 0.5 to about 10 percent by weight, and preferably from about 1 to about 5 percent by weight of carrier core, conductive additive such as for example, conductive carbon black in the amount range of from about 10 to about 70 percent by weight, and preferably from about 20 to about 50 percent by weight of monomer, or mixture or monomers initiator in the amount range of from about 0.1 to about 20 percent by weight, and preferably from about 0.5 to about 10 percent by weight of monomer, or mixtures of monomers, optional chain transfer agent in the range amount of from about 0.01 to about 1 percent by weight, and preferably from about 0.05 to about 0.5 percent by weight of monomer or monomer mixture, and optional crosslinking agent in the range amount of from about 0.1 to about 5 percent by weight, and preferably from about 0.5 to about 3 percent by weight of monomer or monomer mixture in a stirred reactor vessel for a period of time of for example, from about 5 minutes to about 1 hour in order to allow the aforementioned mixture to diffuse into the carrier pores; polymerizing to a conversion of from about 5 to about 20 percent by heating to a temperature of for example, from about 50° C. to about 95° C., and preferably from about 60° C. to about 85° C. for a period of time in the range of for example, from about 30 minutes to about 5 hours and wherein the polymer resulting fills substantially all, or is contained in the carrier pores and covers substantially all the carrier surface and wherein the carrier particles do not adhere to each other; removing excess monomer from carrier surface by for example filtration; mixing the carrier core containing polymer and monomer mixture inside the pores and on the carrier surface into water; completing the polymerization and crosslinking by heating to a temperature in the range of for example, from about 50° C. to about 95° C., and preferably from about 60° C. to about 85° C. and mixing the mixture for a period of time in the range of for example, from about 1 hour to about 5 hours and wherein the rate of stirring is substantially the same as in the mixing step; removing the water from the mixture by for example decantation; and drying resulting in conductive carrier with crosslinked polymer in the pores, and on the surface.

The polymerization process of the present invention enables the synthesis of carriers with wide ranges of triboelectric charging values, carried selected conductivity, and small carrier size for example from about 30 to about 100 microns, and preferably from about 30 to about 50 microns in volume average diameter as determined by a Malvern laser diffractometer. Further, when resin coated carrier particles are prepared by the polymerization process of the present invention, the majority, that is, over 90 percent of the coating materials, such as polymer, or polymers are fused to the carrier surface thereby reducing the number of toner impaction sites on the carrier material. Additionally, there can be achieved with the process of the present invention, independent of one another, desirable triboelectric charging characteristics and conductivity values; that is, for example the triboelectric charging parameter is not primarily dependent on the carrier coating weight as is believed to be the situation with the process of U.S. Pat. No. 4,233,387, wherein an increase in coating weight on the carrier particles may function to also permit an increase in the triboelectric charging characteristics. Specifically, therefore, with the carrier compositions and process of the present invention there can be formulated developers with selected triboelectric charging characteristics and/or conductivity values in a number of different combinations.

Accordingly, for example, there can be formulated in accordance with the invention of the present application carriers with conductivities of from about $10^{-17}$ mho/cm to about $10^{-4}$ mho/cm, and preferably from about $10^{-15}$ mho/cm to about $10^{-6}$ mho/cm, as determined in a magnetic brush conducting cell; and triboelectric charging values of from about 80 to about −80 microcoulombs per gram, and preferably from about 60 to about −60 microcoulombs per gram, on the carrier particles as determined by the known Faraday cage technique. The developers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by retaining the polymer ratio coating constant and modifying the coating weight for the carrier particles.

Toners can be admixed with the carrier to generate developers. As one preferred toner resin there can be selected the esterification products of a dicarboxylic acid and a diol comprising a diphenol, reference U.S. Pat. No. 3,590,000 the disclosure of which is totally incorporated herein by reference, reactive extruded polyesters, such as those illustrated in U.S. Pat. No. 5,227,460, the disclosure of which is totally incorporated herein by reference, and the like. Preferred toner resins include styrene/methacrylate copolymers; styrene/butadiene copolymers; polyester resins obtained from the reaction of bisphenol A and propylene oxide; and branched polyester resins resulting from the reaction of dimethylterephthalate, 1,3-butanediol, 1,2-propanediol and pentaerthriol. Other toner resins are illustrated in a number of U.S. patents including some of the patents recited hereinbefore.

Generally, from about 1 part to about 5 parts by weight of toner are mixed with from about 10 to about 300 parts by weight of the carrier particles.

Numerous well known suitable colorants, such as pigments or dyes can be selected as the colorant for the toner particles including, for example, cyan, magenta, yellow, red, blue, carbon black, nigrosine dye, lamp black, iron oxides, magnetites, and mixtures thereof. The colorant, which is preferably carbon black, should be present in a sufficient amount to render the toner composition highly colored.

Thus, the colorant particles are present in amounts of from about 3 percent by weight to about 20 and preferably from about 3 to about 12 weight percent or percent by weight, based on the total weight of the toner composition, however, lesser or greater amounts of colorant particles can be selected. Colorant includes pigment, dye, mixtures thereof, mixtures of pigments, mixtures of dyes, and the like.

When the colorant particles are comprised of magnetites, which are a mixture of iron oxides ($FeO.Fe_2O_3$) including those commercially available as Mapico Black, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin is selected. Generally, toner composition is comprised of from about 85 percent to about 97 percent by weight of toner resin particles, and from about 3 percent by weight to about 15 percent by weight of colorant particles such as carbon black.

The developer compositions can be comprised of toner thermoplastic resin particles, carrier particles and as colorants, magenta, cyan and/or yellow particles, as well as mixtures thereof. More specifically, illustrative examples of magentas include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyans include copper tetra-4(octaecyl sulfonamido)phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellows are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33; 2,5-dimethoxy-4-sulfonanilide phenylazo-4'-chloro-2,5-dimethoxy acetoacetanilide, permanent yellow FGL, and the like. The colorants are generally present in the toner composition an amount of from about 1 weight percent to about 15 weight percent based on the weight of the toner resin particles.

For further enhancing the positive charging characteristics of the developer compositions described herein, and as optional components there can be incorporated therein known charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; metal complexes, E-88™, naphthalene sulfonates, quaternary ammonium compounds; and other similar known charge enhancing additives. These additives are usually incorporated into the toner in an amount of from about 0.1 percent by weight to about 20, and preferably from about 1 to about 7 weight percent by weight.

The toner composition of the present invention can be prepared by a number of known methods including melt blending the toner resin particles, and pigment particles or colorants of the present invention followed by mechanical attrition. Other methods include emulsion aggregates spray drying, melt dispersion, dispersion polymerization and suspension polymerization. In one dispersion polymerization method, a solvent dispersion of the resin particles and the colorant particles are spray dried under controlled conditions to result in the desired product.

Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. Nos. 4,265,990, 4,585,884, 4,584,253, and 4,563,406 the disclosures of which are totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in the '990 patent. Also, there can be selected as photogenerating pigments, squaraine compounds, thiapyrillium materials hydroxy gallium phthalocyanine, and the like. These layered members are conventionally charged negatively thus requiring a positively charged toner. Other photoresponsive devices useful in the present invention include polyvinylcarbazole 4-dimethylaminobenzylidene, benzhydrazide; 2-benzylidene-aminocarbazole, 4-dimethamino-benzylidene, (2-nitrobenzylidene)-p-bromoaniline; 2,4-diphenyl-quinazoline; 1,2,4-triazine; 1,5-diphenyl-3-methyl pyrazoline 2-(4'-dimethylaminophenyl)-benzoaxzole; 3-aminocarbazole, polyvinyl carbazole-trinitrofluorenone charge transfer complex; and mixtures thereof. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with this developer composition had acceptable solids, excellent halftones and desirable line resolution, with acceptable or substantially no background deposits.

The following examples are being provided to further define the present invention, it being noted that these examples are intended to illustrate and not limit the scope of the present invention. Parts and percentages are by weight unless otherwise indicated.

EXAMPLE I

There are prepared carrier particles by mixing 30 grams of a porous CuZn ferrite powder obtained from Powdertech Corp. and having an average particle diameter of about 32 microns and a BET surface area of about 1,600 $cm^2/g$, with 103 grams of a mixture comprised of 98 grams methyl methacrylate, 2 grams divinyl benzene crosslinking agent, 2 grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the methyl methacrylate in the carrier pores to polymethyl methacrylate to a conversion of from about 5 to about 40 percent, and to simultaneously partially polymerize the methyl methacrylate and fully coat on the carrier surface polymethyl methacrylate to a conversion of from about 5 to about 40 percent. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reaction. Thereafter, the water is decanted from the mixture and the mixture is dried overnight, about 18 hours, in an oven at about 80° C. The resulting product is comprised of a carrier core of CuZn ferrite, and with substantially all the pores, about 95 to 99 percent thereof being substantially filled, that is each pore being about 90 to 100 percent filled with crosslinked polymethyl methacrylate, and coated with crosslinked poblymethyl methacrylate polymer. The product contains about 5.1 percent by weight of substantially crosslinked polymer in the pores and on the surface and about 94.9 percent by weight of the above porous CuZn ferrite core material as measured by thermal gravimetric analysis. Examination of the carrier particles using scanning electron microscopy with back scatter electron imaging indicates substantial evidence of crosslinked polymer filling the pores and fully covering the surface of the carrier particles.

Thereafter, a developer mixture is prepared by mixing 24 grams of the above prepared carrier with 1 gram of a toner comprised of 89 percent by weight of the extruded partially crosslinked propoxylated bisphenol A fumarate polyester containing about 30 percent gel of U.S. Pat. No. 5,227,460, the disclosure of which is totally incorporated herein by reference, 5 percent by weight of REGAL 330® carbon black, 6 percent by weight of low molecular weight 660P wax available from Sanyo Chemicals of Japan, and as a surface additive 1 percent by weight of TS530 AEROSIL® fumed silica, available from Degussa Chemicals.

The triboelectric charge on the carrier is then measured by preparing a developer containing about 3 to 10 percent by weight toner and about 90 to 97 percent by weight carrier to obtain a value of about 32 microcoulombs/g. Further, the conductivity of the carrier as determined by forming a 0.1 inch long magnetic brush of the carrier particles, and measuring the conductivity by imposing a 10 volt potential across the brush is about $10^{-15}$ mho/cm. Therefore, the carrier particles are insulative.

In all of the Examples, the triboelectric charging values and the conductivity are obtained in accordance with the aforementioned procedures.

EXAMPLE II

There are prepared carrier particles by mixing 30 grams of a porous CuZn ferrite powder obtained from Powdertech Corp. and with an average particle diameter of about 32 microns and a BET surface area of about 1,600 $cm^2/g$, with a 103 gram mixture comprised of 98 grams styrene, 2 grams divinyl benzene crosslinking agent, 2 grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the styrene in the carrier pores to polystyrene to a conversion of from about 5 to about 40 percent, and to simultaneously partially polymerize the styrene and fully coat the polystyrene on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reactions. Following this, the water is decanted from the mixture and the mixture is dried overnight, about 18 hours throughout, in an oven at about 80° C. The resulting product is comprised of a carrier core of CuZn ferrite, and with all the pores, about 95 to 99 percent thereof being substantially filled, that is each pore about 90 to 100 percent filled with crosslinked polystyrene, and coated with crosslinked polystyrene. The product contains about 5.0 percent by weight of substantially crosslinked polymer in the pores and on the surface and about 95.0 percent by weight of the above porous CuZn ferrite core material as measured by thermal gravimetric analysis. Examination of the carrier particles using scanning electron microscopy with back scatter electron imaging indicates substantial evidence of polymer filling the pores and fully covering the surface of the carrier particles. The carrier triboelectric charging value about 5 microcoulombs/g and the carrier conductivity is about $3\times10^{-15}$ mho/cm determined by repeating the process of EXAMPLE I. Therefore, the carrier particles are insulative.

EXAMPLE III

There are prepared carrier particles by mixing 30 grams of a porous CuZn ferrite powder obtained from Powdertech Corp. and with an average particle diameter of about 30 microns and a BET surface area of about 1,600 $cm^2/g$, with a 103 gram mixture comprised of 98 grams trifluoroethyl methacrylate, 2 grams divinyl benzene crosslinking agent, 2-grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the trifluoroethyl methacrylate in the carrier pores to polytrifluoroethyl methacrylate to a conversion of from about 5 to about 40 percent, and to simultaneously partially polymerize the trifluoroethyl methacrylate and fully coat the trifluoroethyl methacrylate polymer on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to accomplish the polymerization and crosslinking reaction to completion. Following this, the water is decanted from the mixture and the mixture is dried overnight, about 18 hours throughout, in an oven at about 80° C. The resulting product is comprised of a carrier core of CuZn ferrite; and with all the pores, about 95 to 99 percent thereof being substantially filled, that is each pore about 90 to 100 percent filled with crosslinked polytrifluoroethyl methacrylate, and which carrier core is coated with crosslinked polytrifluoroethyl methacrylate. The product contains about 4.8 percent by weight of substantially crosslinked polymer in the pores and on the surface and about 95.2 percent by weight of the above porous CuZn ferrite core material as measured by thermal gravimetric analysis. Examination of the carrier particles using scanning electron microscopy with back scatter electron imaging indicates substantial evidence of polymer filling the pores and fully covering the surface of the carrier particles. The carrier triboelectric charging value is about −29 microcoulombs/g and the carrier conductivity is about $2\times10^{-15}$ mho/cm, determined by repeating the-process of EXAMPLE I. Therefore, the carrier particles are insulative.

EXAMPLE IV

There are prepared carrier particles by mixing 30 grams of a porous sponge iron powder obtained from Hoeganaes Corp. and with an average particle diameter of about 35 microns and a BET surface area of about 1,400 $cm^2/g$, with a 87.55 gram mixture comprised of 83.3 grams methyl methacrylate, 1.7 grams divinyl benzene crosslinking agent, 1.7 grams of 2,2'-azodimethylvaleronitrile, and 0.85 grams benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the methyl methacrylate in the carrier pores to polymethyl methacrylate to a conversion of from about 5 to about 40 percent, and to simultaneously partially polymerize methyl methacrylate and partially coat polymethyl methacrylate on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reactions. Following this, the water is decanted from the mixture and the mixture is dried overnight, about 18 hours throughout, in an oven at about 80° C. The resulting product is comprised of a carrier core of sponge iron, and with all the pores, about 95 to 99 percent thereof being substantially filled, that is each pore about 90 to 100 percent filled with crosslinked polymethyl methacrylate, and coated with crosslinked polymethyl methacrylate. The product contains about 4.3 percent by weight of substantially crosslinked polymer in the pores and on the surface and about 95.7 percent by weight of the above porous sponge iron core material as measured by thermal gravimetric analysis. Examination of the carrier particles using scanning electron microscopy with back scatter electron imaging indicates substantial evidence of polymer filling the pores and about 52 percent surface coverage of the carrier particles. The carrier triboelectric charging value is about 48 microcoulombs/g and the carrier conductivity is about $2\times10^{-8}$ mho/cm determined in this EXAMPLE and the EXAMPLES that follow by repeating the process of EXAMPLE I. Therefore, the carrier particles are conductive.

EXAMPLE V

There are prepared carrier particles by mixing 30 grams of a porous sponge iron powder obtained from Hoeganaes Corp. and with an average particle diameter of about 35 microns and a BET surface area of about 1400 $cm^2/g$, with a 87.55 gram mixture comprised of 83.3 grams styrene, 1.7 grams divinyl benzene crosslinking agent, 1,7 grams of 2,2'-azodimethylvaleronitrile, and 0.85 grams benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the styrene in the carrier pores to polystyrene to a conversion of from about 5 to about 40 percent, and to simultaneously partially polymerize the styrene and partially coat polystyrene on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to accomplish the polymerization and crosslinking reaction to completion. Following this, the water is decanted from the mixture and the mixture is dried overnight, about 18 hours throughout, in an oven at about 80° C. The resulting product is comprised of a carrier core of sponge iron, and with all the pores, about 95 to 99 percent thereof being substantially filled, that is each pore about 90 to 100 percent filled with crosslinked polystyrene, and coated with crosslinked polystyrene. The product contains about 4.4 percent by weight of substantially crosslinked polymer in the pores and on the surface and about 95.6 percent by weight of the above porous sponge iron core material as measured by thermal gravimetric analysis. Examination of the carrier particles using scanning electron microscopy with back scatter electron imaging indicates substantial evidence of polymer filling the pores and about 47 percent surface coverage of the carrier particles. The carrier triboelectric charging value is about 15 microcoulombs/g and the carrier conductivity is about $3\times10^{-8}$ mho/cm. Therefore, the carrier particles are conductive.

EXAMPLE VI

There are prepared carrier particles by mixing 30 grams of a porous sponge iron powder obtained from Hoeganaes Corp. and with an average particle diameter of about 35 microns and a BET surface area of about 1,400 $cm^2/g$, with a 87.55 gram mixture comprised of 83.3 grams trifluoroethyl methacrylate, 1.7 grams divinyl benzene crosslinking agent, 1.7 grams of 2,2'-azodimethylvaleronitrile, and 0.85 grams benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the trifluoroethyl methacrylate in the carrier pores to polytrifluoroethyl methacrylate to a conversion of from about 5 to about 40 percent, and to simultaneously partially polymerize the methacrylate monomer and partially coat polytrifluoroethyl methacrylate on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete polymerization and crosslinking reactions. Following this, the water is decanted from the mixture and the mixture is dried overnight, about 18 hours throughout, in an oven at about 80° C. The resulting product is comprised of a carrier core of sponge iron, and with all the pores, about 95 to 100 percent thereof being substantially filled, that is each pore about 90 to 100 percent filled with crosslinked polytrifluoroethyl methacrylate, and coated with crosslinked polytrifluoroethyl methacrylate. The product contains about 4.2 percent by weight of substantially crosslinked polymer in the pores and on the surface and about 95.8 percent by weight of the above porous sponge iron core material as measured by thermal gravimetric analysis. Examination of the carrier particles using scanning electron microscopy with back scatter electron imaging indicates substantial evidence of polymer filling the pores and about 53 percent surface coverage of the carrier particles. The carrier triboelectric charging value is about −10 microcoulombs/g and the carrier conductivity is about $4\times10^{-8}$ mho/cm. Therefore, the carrier particles are conductive.

EXAMPLE VII

There are prepared carrier particles by mixing 30 grams of a porous CuZn ferrite powder obtained from Powdertech Corp. and having an average particle diameter of about 32 microns and a BET surface area of about 1,600 $cm^2/g$, with a 123 gram mixture comprised of 98 grams methyl methacrylate, 20 grams CONDUCTEX SC Ultra$_{TM}$ conductive carbon black, 2 grams divinyl benzene crosslinking agent, 2 grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the methyl methacrylate in the carrier pores to polymethyl methacrylate to a conversion of from about 5 to about 40 percent, and to simultaneously partially polymerize the methacrylate monomer and fully coat polymethyl methacrylate on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reactions. Subsequently, the water is decanted from the mixture and the mixture is dried overnight in an oven at about 80° C. The resulting product is comprised of a carrier core of CuZn ferrite, and with all the pores, about 95 to 99 percent thereof being substantially filled, that is each pore about 90 to 100 percent filled with crosslinked polymethyl methacrylate and carbon black dispersed therein, and coated with crosslinked polymethyl methacrylate and carbon black dispersed therein. The product contains about 5.0 percent by weight of substantially crosslinked polymer and about 1.0 percent by weight of carbon black in the pores and on the surface and about 94.0 percent by weight of the above porous CuZn ferrite core material as measured by thermal gravimetric analysis. Examination of the particles using scanning electron microscopy with back scatter electron imaging indicates substantial evidence of polymer filling the pores and fully covering the surface of the carrier particles. The carrier triboelectric charging value is about 21 microcoulombs/g and the carrier conductivity is about $4\times10^{-7}$ mho/cm. Therefore, the carrier particles are conductive.

EXAMPLE VIII

There are prepared carrier particles by mixing 30 grams of a porous CuZn ferrite powder obtained from Powdertech Corp. and having an average particle diameter of about 32 microns and a BET surface area of about 1,600 $cm^2/g$, with a 123 gram mixture comprised of 98 grams styrene, 20 grams CONDUCTEX SC Ultra$_{TM}$ conductive carbon black, 2 grams divinyl benzene crosslinking agent, 2 grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the styrene in the carrier pores to polystyrene to a conversion of from about 5 to about 40 percent, and to simultaneously partially polymerize styrene and fully coat polystyrene on the carrier surface. The reaction mixture is then filtered through a #3 Whatman filter to remove the excess monomer from the carrier surface. The filtered material is then added to 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reactions. Subsequently, the water is decanted from the mixture and the mixture is dried overnight in an oven at about 80° C. The resulting product is comprised of a carrier core of CuZn ferrite, and with all the pores, about 95 to 99 percent thereof being substantially filled, that is each pore about 90 to 100 percent filled with crosslinked polystyrene, and coated with crosslinked polystyrene. The product contains about 5.1 percent by weight of substantially crosslinked polymer and about 1.0 percent by weight of carbon black in the pores and on the surface and about 93.9 percent by weight of the above porous CuZn ferrite core material as measured by thermal gravimetric analysis. Examination of the particles using scanning electron microscopy with back scatter electron imaging indicates substantial evidence of polymer filling the pores and fully covering the surface of the carrier particles. The carrier triboelectric charging value is about 2 microcoulombs/g and the carrier conductivity is about $2\times10^{-7}$ mho/cm. Therefore, the carrier particles are conductive.

EXAMPLE IX

There are prepared carrier particles by mixing 30 grams of a porous CuZn ferrite powder obtained from Powdertech Corp. and having an average particle diameter of about 32 microns and a BET surface area of about 1,600 $cm^2/g$ with a 123 gram mixture comprised of 98 grams trifluoroethyl methacrylate, 20 grams CONDUCTEX SC Ultra$_{TM}$ conductive carbon black, 2 grams divinyl benzene crosslinking agent, 2 grams of 2,2'-azodimethylvaleronitrile, and 1 gram benzoyl peroxide. These components are measured into a 500 mL glass reactor and stirred for about 60 minutes at about 300 rpm. The reactor is then placed into a water bath at about 55° C. and bulk polymerized for about 60 minutes, while stirred substantially at the same speed, 300 rpm in order to partially polymerize the trifluoroethyl methacrylate in the carrier pores to polytrifluoroethyl methacrylate to a conversion of from about 5 to about 40 percent, and to simultaneously partially polymerize the methacrylate monomer and fully coat polytrifluoroethyl methacrylate on the carrier surface to polytrifluoroethyl methacrylate. The reaction mixture is then filtered through a #3 Whatman filter to remove the excess monomer from the carrier surface. The filtered material is then added to. 150 grams of water in a 500 mL glass reactor and stirred at about 300 rpm. The reactor is placed into a water bath at about 55° C. and ramped up to about 95° C. The mixture is stirred at this temperature for about 60 minutes to complete the polymerization and crosslinking reactions. Subsequently, the water is decanted from the mixture and the mixture is dried overnight in an oven at about 80° C. The resulting product is comprised of a carrier core of CuZn ferrite, and with all the pores, about 96 to 100 percent thereof being substantially filled, that is each pore about 90 to 99 percent filled with crosslinked polytrifluoroethyl methacrylate, and coated with crosslinked polytrifluoroethyl methacrylate. The product contains about 5.0 percent by weight of substantially crosslinked polymer and about 1.0 percent by weight of carbon black in the pores and on the surface and about 94.0 percent by weight of the above porous CuZn ferrite core material as measured by thermal gravimetric analysis. Examination of the particles using scanning electron microscopy with back scatter electron imaging indicates substantial evidence of polymer filling the pores and fully covering the surface of the carrier particles. The carrier triboelectric charging value is about −11 microcoulombs/g and the carrier conductivity is about $5\times10^{-7}$ mho/cm. Therefore, the carrier particles are conductive.

For the above Examples the triboelectric values and other values were determined subsequent to the preparation of a developer as indicated herein reference for example, Example I.

Other modifications of the present invention may occur to those skilled in the art subsequent to a review of the present application. The aforementioned modifications, including equivalents thereof, are intended to be included within the scope of the present invention.

What is claimed is:

1. A process for the preparation of carrier comprised of mixing carrier core with a mixture of monomer and initiator, optional chain transfer agent, and optional crosslinking agent; polymerizing the monomer by heating thereby resulting in a polymer contained in a number of the carrier pores and on the carrier surface; and optionally drying.

2. A process in accordance with claim 1 wherein the monomer and initiator mixture further contains a conductive additive.

3. A process in accordance to claim 2 wherein the conductive additive is selected from the group consisting of conductive carbon blacks, metal oxides, metals, and mixtures thereof, and where the amount of said conductive additive present is from about 10 to about 70 percent by weight, or from about 20 to about 50 percent by weight of said monomer.

4. A process in accordance to claim 2 wherein the conductive additive is conductive carbon black.

5. A process in accordance to claim 1 wherein the heating is at a temperature from about 50° C. to about 95° C., or from about 60° C. to about 85° C.

6. A process in accordance to claim 1 wherein the heating is for a period of from about 30 minutes to about 5 hours, or from about 30 minutes to about 3 hours.

7. A process in accordance to claim 1 wherein the monomer is selected from the group consisting of styrene, α-methyl styrene, p-chlorostyrene, monocarboxylic acids and the derivatives thereof; dicarboxylic acids with a double bond and their derivatives; vinyl ketones; vinyl naphthalene; unsaturated mono-olefins; vinylidene halides; N-vinyl compounds; fluorinated vinyl compounds; and mixtures thereof; and wherein said monomer is optionally present in an amount of from about 0.5 to about 10 percent by weight, or from about 1 to about 5 percent by weight of said carrier core.

8. A process in accordance to claim 1 wherein the monomer is selected from the group consisting of acrylic acid, methyl acrylate, ethyl acrylate, n-butyl acrylate, isobutyl acrylate, dodecyl acrylate, n-octyl acrylate, 2-chloroethyl acrylate, phenyl acrylate, methylalphachloroacrylate, methacrylic acids, methyl methacrylate, ethyl methacrylate, butyl methacrylate, octyl methacrylate, acylonitrile, methacrylonitrile and acrylamide; maleic acid, monobutyl maleate, dibutyl maleate; vinyl chloride, vinyl bromide, vinyl fluoride, vinyl acetate and vinyl benzoate; vinylidene chloride; pentafluoro styrene, allyl pentafluorobenzene, N-vinyl pyrrole, and trifluoroethyl methacrylate; and mixtures thereof; and wherein said monomer is present in an amount of from 0.5 to about 10 percent by weight, or from about 1 to about 5 percent by weight of said carrier core.

9. A process in accordance to claim 1 wherein the monomer is methyl methacrylate, styrene, trifluoroethyl methacrylate, or mixtures thereof, and wherein said monomer is present in an amount of from 0.5 to about 10 percent by weight, or from about 1 to about 5 percent by weight of said carrier core.

10. A process in accordance to claim 1 wherein the initiator is selected from the group consisting of azo compounds, peroxides, and mixtures thereof, and where the amount of said initiator is from about 0.1 to about 20 percent by weight or from about 0.5 to about 10 percent by weight of said monomer.

11. A process in accordance to claim 1 wherein the initiator is selected from the group consisting of 2,2'azodimethylvaleronitrile, 2,2'azoisobutyronitrile, azobiscyclohexanenitrile, 2-methylbutyronitrile, benzoyl peroxides, lauryl peroxide, 1-1-(t-butylperoxy)-3,3,5-trimethylcyclohexane, n-butyl-4,4-di-(t-butylperoxy) valerate, dicumyl peroxide, and mixtures thereof.

12. A process in accordance to claim 1 wherein the crosslinking agent is selected from the group consisting of compounds having two or more polymerizable double bonds, and where the amount of said crosslinking agent is from about 0.1 to about 5 percent by weight, or from about 0.5 to about 3 percent by weight of said monomer.

13. A process in accordance to claim 1 wherein the crosslinking agent is selected from the group consisting of divinylbenzene, divinylnaphthalene, ethylene glycol diacrylate, ethylene glycol dimethylacrylate, divinyl ether, divinyl sulfite, divinyl sulfone, and mixtures thereof.

14. A process in accordance to claim 1 wherein the chain transfer agent is selected from the group consisting of mercaptans and halogenated hydrocarbons, and where chain transfer agent is selected in an amount of from about 0.01 to about 1 percent by weight, or from about 0.05 to about 0.5 percent by weight of said monomer.

15. A process in accordance with to claim 1 wherein the chain transfer agent is selected from the group consisting of laurylmercaptan, butylmercaptan carbon tetrachloride, carbon tetrabromide and mixtures thereof.

16. An insitu process for the preparation of carrier comprising mixing carrier core with a mixture of monomer and initiator, optional chain transfer agent, and optional crosslinking agent; polymerizing the monomer by heating thereby resulting in a polymer, or crosslinked polymer in the carrier pores and on the carrier surface; mixing the carrier core containing polymer and monomer mixture inside the pores and on the carrier surface with water; completing the polymerization and optionally crosslinking by heating thereby resulting in a polymer, or crosslinked polymer in the carrier pores and on the carrier surface; removing the water from the mixture; and optionally drying.

17. A process in accordance with claim 16 wherein excess monomer is removed by filtration; the water is removed from the mixture by filtration; and drying in an oven is conducted.

* * * * *